US010290962B2

(12) United States Patent
Harmon, III

(10) Patent No.: US 10,290,962 B2
(45) Date of Patent: May 14, 2019

(54) DUAL CONNECTOR SYSTEM

(71) Applicant: TE CONNECTIVITY CORPORATION, Berwyn, PA (US)

(72) Inventor: Dean Marlin Harmon, III, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 10 days.

(21) Appl. No.: 15/492,042

(22) Filed: Apr. 20, 2017

(65) Prior Publication Data

US 2018/0309213 A1 Oct. 25, 2018

(51) Int. Cl.

| | |
|---|---|
| ***H01R 12/71*** | (2011.01) |
| ***H01R 12/70*** | (2011.01) |
| ***H01R 13/633*** | (2006.01) |
| ***H01R 27/02*** | (2006.01) |
| ***H01R 13/627*** | (2006.01) |
| ***H01R 12/73*** | (2011.01) |
| *H01R 24/50* | (2011.01) |
| *H01R 24/28* | (2011.01) |

(Continued)

(52) U.S. Cl.

CPC ..... *H01R 12/716* (2013.01); *H01R 12/7005* (2013.01); *H01R 12/73* (2013.01); *H01R 13/6275* (2013.01); *H01R 13/6335* (2013.01); *H01R 27/02* (2013.01); *H01R 12/7076* (2013.01); *H01R 12/71* (2013.01); *H01R 12/83* (2013.01); *H01R 13/6315* (2013.01); *H01R 13/6587* (2013.01); *H01R 13/7132* (2013.01); *H01R 24/005* (2013.01); *H01R 24/28* (2013.01); *H01R 24/50* (2013.01)

(58) Field of Classification Search

CPC ..... H01R 13/7132; H01R 12/716

See application file for complete search history.

(56) References Cited

U.S. PATENT DOCUMENTS 3,479,634 A * 11/1969 Pritulsky ..... H01R 12/728 439/560

4,678,252 A 7/1987 Moore (Continued)

OTHER PUBLICATIONS

Tyco Electronic, Product Specification, DDR S.O.DIMM Socket 200 Positions, Jul. 11, 2007, 5 pages.

(Continued)

*Primary Examiner* — James Harvey

(57) ABSTRACT

A dual connector system includes a host circuit board with first and second electrical connectors. The first electrical connector has a housing with a card slot, first contacts and a latching feature. The second electrical connector has a housing with second contacts. The dual connector system includes a dual connector module having a module circuit board having contact pads. The dual connector module has a latch movable between a latched position and an unlatched position. The latch engages the latching feature of the first electrical connector in the latched position to hold the dual connector module in a mated position. A release mechanism is operably coupled between the dual connector module and at least one of the first electrical connector and the second electrical connector. The release mechanism forces the dual connector module to an unmated position after the latch is moved from the latched position to the unlatched position.

20 Claims, 6 Drawing Sheets

(51) Int. Cl.

| | |
|---|---|
| *H01R 13/6587* | (2011.01) |
| *H01R 24/00* | (2011.01) |
| *H01R 13/713* | (2006.01) |
| *H01R 13/631* | (2006.01) |
| *H01R 12/83* | (2011.01) |

(56) References Cited

U.S. PATENT DOCUMENTS

| | | | | |
|---|---|---|---|---|
| 5,242,312 | A | 9/1993 | Tondreault | |
| 5,260,854 | A * | 11/1993 | Hileman | H05K 7/142 361/736 |
| 5,324,204 | A | 6/1994 | Lwee | |
| 5,643,001 | A | 7/1997 | Kaufman et al. | |
| 6,394,817 | B1 * | 5/2002 | Kihira | H01R 13/701 439/63 |
| 7,018,222 | B2 | 3/2006 | Chang | |
| 7,074,090 | B2 | 7/2006 | Ho et al. | |
| 7,101,222 | B2 | 9/2006 | Ho et al. | |
| 7,300,298 | B2 | 11/2007 | Kameda | |
| 7,344,402 | B2 | 3/2008 | Langgood et al. | |
| 7,467,963 | B2 | 12/2008 | Chen | |
| 7,470,136 | B2 | 12/2008 | Yahiro et al. | |
| 7,510,414 | B2 | 3/2009 | Yu et al. | |
| 7,909,644 | B1 * | 3/2011 | Li | H01R 27/02 439/541.5 |
| 7,987,584 | B2 | 8/2011 | Barna et al. | |
| 8,113,883 | B2 | 2/2012 | Chen et al. | |
| 8,544,831 | B2 | 10/2013 | Klein et al. | |
| 8,588,561 | B2 | 11/2013 | Zbinden et al. | |
| 8,764,457 | B2 | 7/2014 | Chen et al. | |
| 8,787,711 | B2 | 7/2014 | Zbinden et al. | |
| 9,166,315 | B1 | 10/2015 | Phillips et al. | |
| 9,871,325 | B2 | 1/2018 | Patel et al. | |
| 9,972,927 | B2 | 5/2018 | Nichols et al. | |
| 9,991,615 | B1 * | 6/2018 | Herring | H01R 12/7005 |
| 2007/0099470 | A1 | 5/2007 | Yang | |
| 2010/0165592 | A1 | 7/2010 | Takao | |
| 2012/0327576 | A1 * | 12/2012 | Xiao | H01R 12/732 361/679.02 |
| 2014/0094063 | A1 * | 4/2014 | Daly | H01R 12/716 439/629 |
| 2014/0111931 | A1 | 4/2014 | Casserly et al. | |
| 2014/0179167 | A1 | 6/2014 | Long et al. | |
| 2015/0318633 | A1 | 11/2015 | Herring et al. | |
| 2016/0134040 | A1 | 5/2016 | Phillips et al. | |
| 2018/0076587 | A1 * | 3/2018 | Herring | H01R 27/02 |

OTHER PUBLICATIONS

TE Connectivity Emboss Assembly DDR1 & DDR2 SODIMM Socket 200P Standard Profile Standard Type, Drawing No. C-1565917, Dec. 2001, 1 page.

Co-pending U.S. Appl. No. 15/458,099, filed Mar. 14, 2017.

Co-pending U.S. Appl. No. 15/490,252, filed Apr. 18, 2017.

Co-pending U.S. Appl. No. 15/492,070, filed Apr. 20, 2017.

Co-pending U.S. Appl. No. 15/723,287, filed Oct. 3, 2017.

* cited by examiner

DUAL CONNECTOR SYSTEM

BACKGROUND OF THE INVENTION

The subject matter herein relates generally to a dual connector system.

Dual connector systems include first and second electrical connectors mounted to a host circuit board that are electrically connected to a dual connector module. The dual connector module includes a module circuit board having connector interfaces for interfacing with the first and second electrical connectors. Typically communication components are mounted to the module circuit board. For example, electrical and/or optical components may be mounted to the module circuit board. In various applications an on-board optics module may be mounted to the module circuit board. Heat dissipation of the communication components may be provided, such as in the form of a heat sink thermally coupled to the communication components and supported by the module circuit board.

Mating of the dual connector module to the first and second electrical connectors typically involves loading the dual connector module into a first position in a vertical direction and then sliding the dual connector module to a second position in a horizontal direction to mate with the first and second electrical connectors. However, unmating of the dual connector module may be difficult. For example, the dual connector module needs to be moved horizontally rearward out of the card slot at the front end before being lifted upward off of the first and second electrical connectors. Some conventional dual connector modules use a tether that extends to the rear end of the dual connector module to release the latch and pull the dual connector module rearward. However, some conventional dual connector modules include cables extending from the rear end of the dual connector module that interfere with the tether. Additionally, actuation or pulling on the tether may damage the cables, such as by bending the cables beyond a bend limit of the cables.

A need remains for a dual connector system that provides a mechanism for unmating the dual connector module from the first and second electrical connectors.

BRIEF DESCRIPTION OF THE INVENTION

In one embodiment, a dual connector system is provided including a host circuit board having a front mounting area and a rear mounting area with a first electrical connector at the front mounting area of the host circuit board and a second electrical connector at the rear mounting area of the host circuit board. The first electrical connector has a housing having a card slot holding first contacts at the card slot that are terminated to the host circuit board. The first electrical connector has a latching feature. The second electrical connector has a housing having an upper mating surface holding second contacts at the upper mating surface that are terminated to the host circuit board. The dual connector system includes a dual connector module movable between a mated position and an unmated position with the first and second electrical connectors. The dual connector module has a module circuit board including an upper surface and a lower surface facing the host circuit board with at least one communication component on the upper surface. The module circuit board has first and second side edges extending between a front edge and a rear edge. The module circuit board has front contact pads proximate to the front edge for electrically connecting to the first electrical connector and rear contact pads remote from the front edge for electrically connecting to the second electrical connector. The dual connector module has a latch movable between a latched position and an unlatched position. The latch engages the latching feature of the first electrical connector in the latched position to hold the dual connector module in the mated position with the first electrical connector. A release mechanism is operably coupled between the dual connector module and at least one of the first electrical connector and the second electrical connector. The release mechanism forces the dual connector module to the unmated position after the latch is moved from the latched position to the unlatched position.

In another embodiment, a dual connector system is provided including a host circuit board having a front mounting area and a rear mounting area with a first electrical connector at the front mounting area of the host circuit board and a second electrical connector at the rear mounting area of the host circuit board. The first electrical connector has a housing having a card slot holding first contacts at the card slot that are terminated to the host circuit board. The first electrical connector has a latching feature. The second electrical connector has a housing having an upper mating surface holding second contacts at the upper mating surface that are terminated to the host circuit board. The dual connector system includes a dual connector module movable between a mated position and an unmated position with the first and second electrical connectors. The dual connector module has a module circuit board including an upper surface and a lower surface facing the host circuit board with at least one communication component on the upper surface. The module circuit board has first and second side edges extending between a front edge and a rear edge. The module circuit board has front contact pads proximate to the front edge for electrically connecting to the first electrical connector and rear contact pads remote from the front edge for electrically connecting to the second electrical connector. The dual connector module has a latch movable between a latched position and an unlatched position. The latch engages the latching feature of the first electrical connector in the latched position to hold the dual connector module in the mated position with the first electrical connector. The dual connector module is coupled to the host circuit board by lowering the dual connector module in a loading direction generally perpendicular to the host circuit board to a pre-staged, unmated position where the first connector interface is adjacent to the first electrical connector and the second connector interface is adjacent to the second electrical connector. The dual connector module is slid forward from the pre-staged, unmated position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads. The dual connector system includes a release mechanism operably coupled between the dual connector module and at least one of the first electrical connector and the second electrical connector. The release mechanism forces the dual connector module to the pre-staged unmated position after the latch is moved from the latched position to the unlatched position.

In a further embodiment, a dual connector system is provided including a host circuit board having a front mounting area and a rear mounting area. A first electrical connector is at the front mounting area of the host circuit board. The first electrical connector has a housing having a card slot configured to receive a front edge of a module circuit board of a dual connector module in a mating direction parallel to the host circuit board. The housing holds first contacts at the card slot configured to be electrically connected to contact pads at the front edge of the module circuit board. The first contacts are terminated to the host circuit board. The first electrical connector has a latching feature configured to engage a latch of the dual connector module to secure the dual connector module in a mated position when the latch engages the latching feature. A second electrical connector is at the rear mounting area of the host circuit board. The second electrical connector has a housing having an upper mating surface configured to receive the module circuit board when mounted thereto. The housing has a release mechanism coupled thereto configured to engage the dual connector module. The release mechanism is configured to impart a releasing force on the dual connector module in an unmating direction opposite the mating direction parallel to the host circuit board to cause the dual connector module to move to an unmated position in the unmating direction after the latch is unlatched from the latching feature of the first electrical connector.

DETAILED DESCRIPTION OF THE INVENTION

Figure 1:
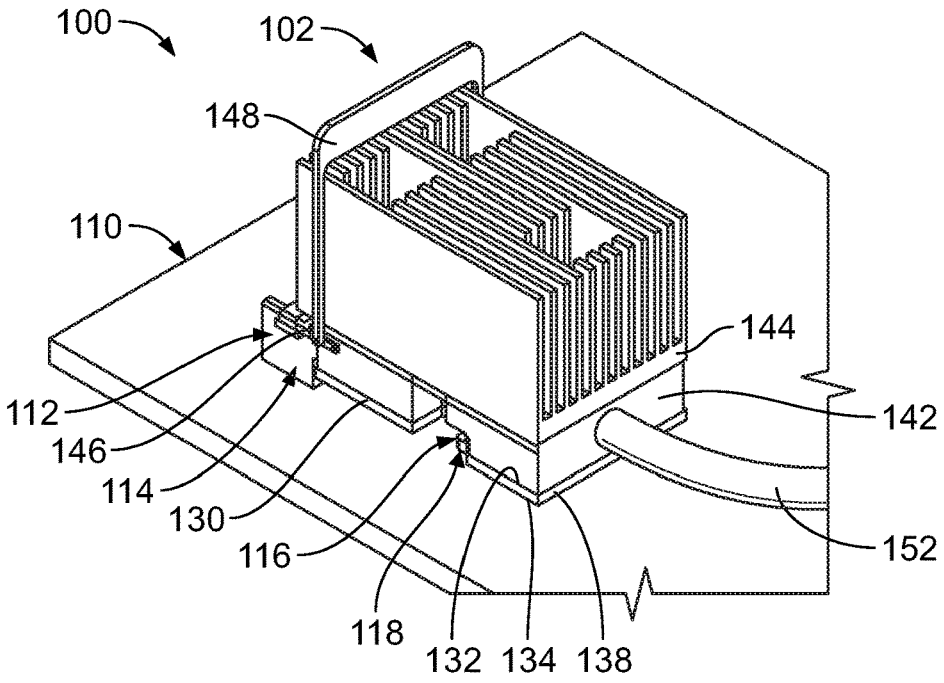
FIG. 1 is a perspective view of a dual connector system formed in accordance with an exemplary embodiment showing a dual connector module mounted to a host circuit board.
Figure 2:
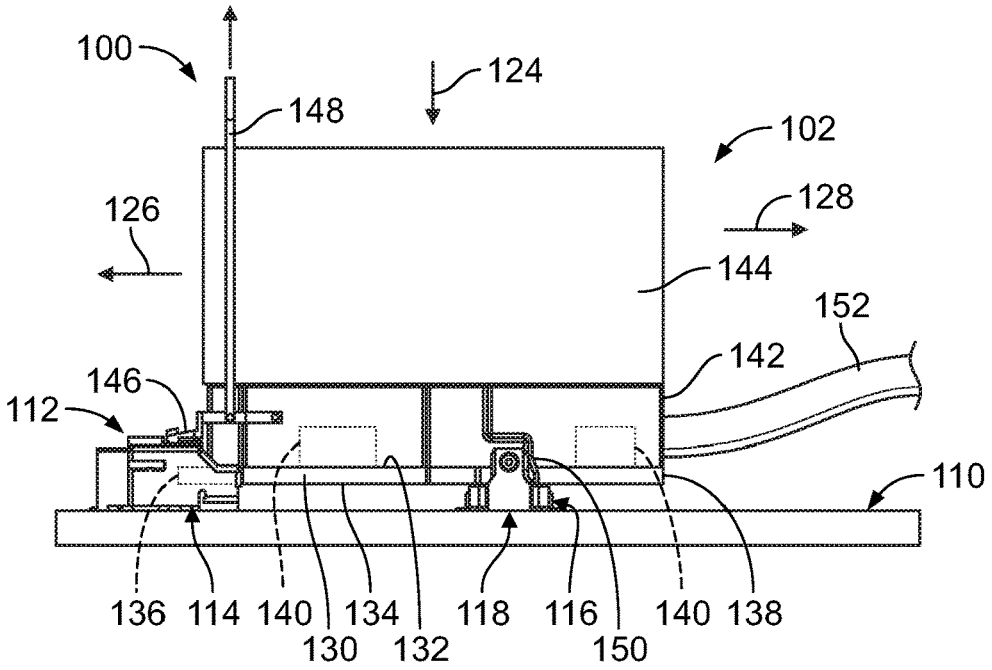
FIG. 2 is a side view of the dual connector system showing the dual connector module mounted to the host circuit board.

FIG. 1 is a perspective view of a dual connector system 100 formed in accordance with an exemplary embodiment showing a dual connector module 102 mounted to a host circuit board 110. FIG. 2 is a side view of the dual connector system 100 showing the dual connector module 102 mounted to the host circuit board 110. The host circuit board 110 has a first electrical connector 112 at a front mounting area 114 of the host circuit board 110 and a second electrical connector 116 at a rear mounting area 118 of the host circuit board 110.

When the dual connector module 102 is mounted to the host circuit board 110, the dual connector module 102 interfaces with both electrical connectors 112, 116. Optionally, the dual connector module 102 may be simultaneously mated with the first and second electrical connectors 112, 116 during a mating process. In an exemplary embodiment, the first electrical connector 112 is a different type of electrical connector than the second electrical connector 116. For example, the first electrical connector 112 may be a front loaded electrical connector, such as a card edge connector. The second electrical connector 116 may be a top loaded electrical connector, such as a mezzanine connector. The electrical connectors 112, 116 may be used for different types of signaling. For example, the first electrical connector 112 may be used for high-speed signaling while the second electrical connector 116 may be used for low speed signaling, powering, or for another type of connection.

In an exemplary embodiment, mating of the dual connector module 102 to the host circuit board 110 occurs by loading the dual connector module 102 in a loading direction 124 (for example, downward) to a pre-staged position and then mating the dual connector module 102 in a mating direction 126 (for example, forward) to a mated position. The dual connector module 102 may be unmated in an opposite unmating direction 128 (for example, rearward) to an unmated position and then removed from the host circuit board 110 by lifting the dual connector module 102 upward. The loading direction 124 may be perpendicular to the host circuit board 110, such as in a vertical direction, and the mating and unmating directions 126, 128 may be parallel to the host circuit board 110, such as in horizontal directions.

The dual connector module 102 includes a module circuit board 130 having an upper surface 132 and a lower surface 134. The module circuit board 130 extends between a front edge 136 (shown in phantom) and a rear edge 138. The lower surface 134 faces the host circuit board 110 and may be parallel to and spaced apart from the host circuit board 110 when mated to the electrical connectors 112, 116.

In an exemplary embodiment, the dual connector module 102 includes one or more communication components 140 on the upper surface 132 and/or the lower surface 134. The communication components 140 may be electrical components, optical components, or other types of components. In an exemplary embodiment, one or more of the communication components 140 may be on-board optical modules. The communication components 140 may include optical/digital converters for converting between optical and electrical signals. Other types of communication components 140 may be provided on the module circuit board 130, such as processors, memory modules, antennas, or other types of components.

In an exemplary embodiment, the dual connector module 102 includes a housing or shell 142 on the upper surface 132. The shell 142 encloses the communication components 140. In an exemplary embodiment, the shell 142 extends generally around the perimeter of the module circuit board 130; however, portions of the module circuit board 130 may be exposed exterior of the shell 142. In an exemplary embodiment, the dual connector module 102 includes a heat sink 144 thermally coupled to one or more of the communication components 140. The heat sink 144 dissipates heat from the communication components 140. The heat sink 144 may be mounted to the shell 142 and/or the module circuit board 130. In an exemplary embodiment, the heat sink 144 extends substantially the entire length of the dual connector module 102. The heat sink 144 may have a plurality of fins having a large surface area for dissipating heat.

In an exemplary embodiment, the dual connector module 102 includes a latch 146 at a front end of the dual connector module 102 for latchably securing the dual connector module 102 to the first electrical connector 112. An actuator 148 is coupled to the latch 146 for releasing the latch 146. In the illustrated embodiment, the actuator 148 extends upward from the latch 146 at the front end of the dual connector module 102. The actuator 148 is configured to be pulled upward to release the latch 146 from a latched position to an unlatched position. Once the latch 146 is released, the dual connector module 102 is able to be moved rearward in the unmating direction 128.

In an exemplary embodiment, the dual connector module 102 is spring actuated by a release mechanism 150 (FIG. 2) that pushes the dual connector module 102 in the unmating direction 128 to remove the front end of the dual connector module 102 from the first electrical connector 112. In the illustrated embodiment, the release mechanism 150 is positioned between the dual connector module 102 and the second electrical connector 116; however the release mechanism 150 may be positioned at other locations, such as between the dual connector module 102 and the first electrical connector 112. In other alternative embodiments, the release mechanism 150 may be a stand-alone device mounted to the host circuit board 110 rather than being mounted to the first or second electrical connectors 112, 116. The release mechanism 150 presses against the dual connector module 102 and/or one of the electrical connectors 112, 116 to push the dual connector module 102 in the unmating direction 128. For example, the release mechanism 150 may be or include a spring that exerts a spring force against the dual connector module 102 to move the dual connector module 102 in the unmating direction.

In an exemplary embodiment, the actuator 148 is at the front end and is accessible from above the dual connector module 102. For example, because one or more cables 152 extend from the rear end of the dual connector module 102, the cable 152 may block access to the space rearward of the dual connector module 102. Routing of the actuator 148 to the rear end of the dual connector module 102 may be impractical because of the location of the cable 152 are limited access to the space behind the dual connector module 102. Additionally, if the actuator 148 were routed to the rear end of the dual connector module 102, actuation of the actuator 148 may damage the cable 152, such as from bending of the cable 152 out of the way to access the actuator 148. In an exemplary embodiment, the actuator 148 extends above the dual connector module 102 and is accessed from above the dual connector module 102. However, in alternative embodiments, the actuator 148 may extend to other locations and may extend to the rear end of the dual connector module 102 to help pull the dual connector module 102 rearward to the unmated position.

Figure 3:
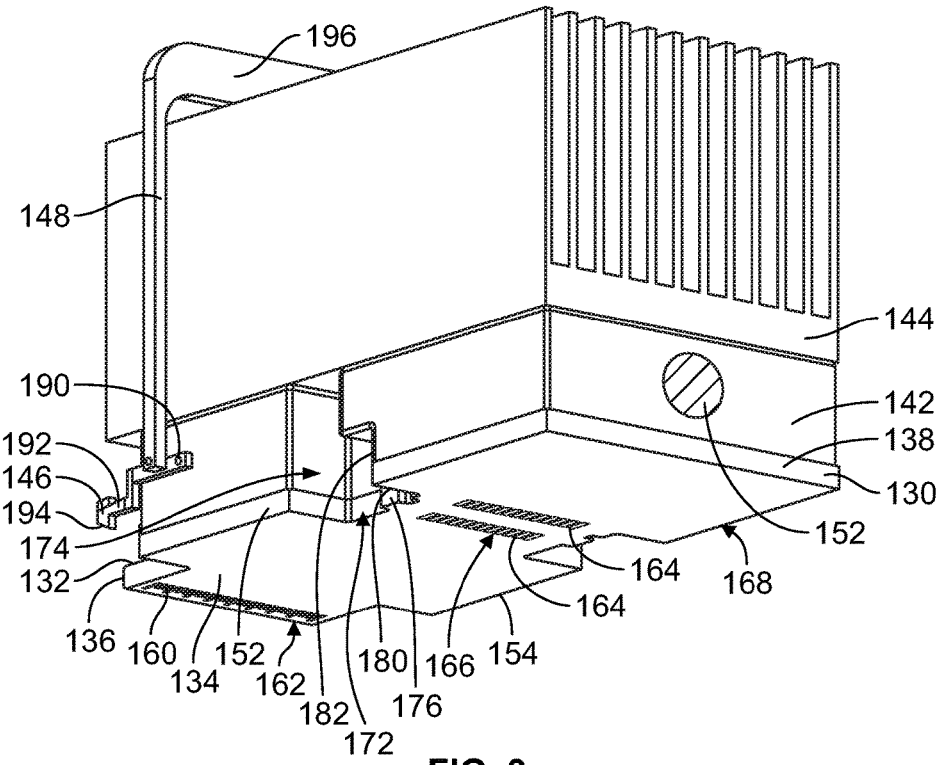
FIG. 3 is a bottom perspective view of the dual connector module in accordance with an exemplary embodiment.

FIG. 3 is a bottom perspective view of the dual connector module 102 in accordance with an exemplary embodiment. In an exemplary embodiment, the module circuit board 130 includes front contact pads 160 proximate to the front edge 136 along the lower surface 134 and/or the upper surface 132. The front contact pads 160 define a first connector interface 162 configured for electrically connecting to the first electrical connector 112 (shown in FIG. 2). For example, the first connector interface 162 may be a card edge interface at the front edge 136 configured to be plugged into a card slot of the first electrical connector 112. The front contact pads 160 are circuits of the module circuit board 130. The front contact pads 160 may be electrically connected to corresponding communication components 140 (shown in FIG. 2) via traces on various layers of the module circuit board 130. In an exemplary embodiment, the front contact pads 160 convey high speed data signals. Optionally, various front contact pads 160 may be arranged in pairs configured to carry differential signals.

The module circuit board 130 includes rear contact pads 164 on the lower surface 134 that define a second connector interface 166 configured for electrically connecting to the second electrical connector 116 (shown in FIG. 2). The rear contact pads 164 may be electrically connected to corresponding communication components 140 via traces on various layers of the module circuit board 130. Optionally, at least some of the rear contact pads 164 may be power pads configured to transmit power between the second electrical connector 116 and the module circuit board 130 for powering the communication components 140. Optionally, the rear contact pads 164 may be provided in multiple rows along the lower surface 134. The rear contact pads 164 are provided at an intermediate portion 168 of the module circuit board 130 remote from the front edge 136 and remote from the rear edge 138. Optionally, the rear contact pads 164 are positioned closer to the rear edge 138 than the front edge 136 and may be positioned at the rear edge 138 in some embodiments.

The module circuit board 130 includes cutouts 172 at the side edges near the intermediate portion 168. The shell 142 includes pockets 174 above the cutouts 172. The cutouts 172 and the pockets 174 are configured to receive portions of the second electrical connector 116 during mating of the dual connector module 102 to the second electrical connector 116 (FIG. 2). In an exemplary embodiment, the module circuit board 130 includes landing pads 176 extending into the cutouts 172. The landing pads 176 are configured to be engaged by the second electrical connector 116 to mechanically secure the dual connector module 102 to the second electrical connector 116.

The module circuit board 130 includes pressing surfaces 180, such as at the rear ends of the cutouts 172. The shell 142 includes pressing surfaces 182, such as at the rear ends of the pockets 174. The release mechanisms 150 (shown in FIG. 1) are configured to engage the pressing surfaces 180, 182. For example, when the release mechanisms 150 are coupled to the second electrical connector 116 (shown in FIG. 1), the release mechanism 150 may press against the pressing surfaces 180 and/or the pressing surfaces 182 to force the dual connector module 102 rearward. In other various embodiments, the release mechanisms 150 may be mounted to the dual connector module 102 at the pressing surfaces 182 and engage the second electrical connector 116, thus pressing against the pressing surfaces 180 and/or the pressing surfaces 182 to force the dual connector module 102 rearward.

The dual connector module 102 includes one or more of the latches 146, such as two latches 146 provided at or near the sides of the dual connector module 102 at the front end of the dual connector module 102. In an exemplary embodiment, each latch 146 is coupled to and extends forward from the shell 142. The latch 146 is pivotably coupled to the shell 142 at a fulcrum 190. The latch 146 includes a latching beam 192 extending forward from the fulcrum 190. The latch 146 includes a hook 194 at the distal end of the latching beam 192 for latching to a corresponding latching feature of the first electrical connector 112.

The actuator 148 is coupled to the latch 146, such as to the latching beam 192, forward of the fulcrum 190. Optionally, the actuator 148 may be a tether coupled to the latch 146. In an exemplary embodiment, the actuator 148 is used to lift the latch 146 upward, such as in a direction perpendicular to the mating direction of the module circuit board 130, to release the latch 146. The actuator 148 may extend along the sides of the heat sink 144 or may extend along the front of the heat sink 144, to a handle 196 used to operate the actuator 148.

Figure 4:
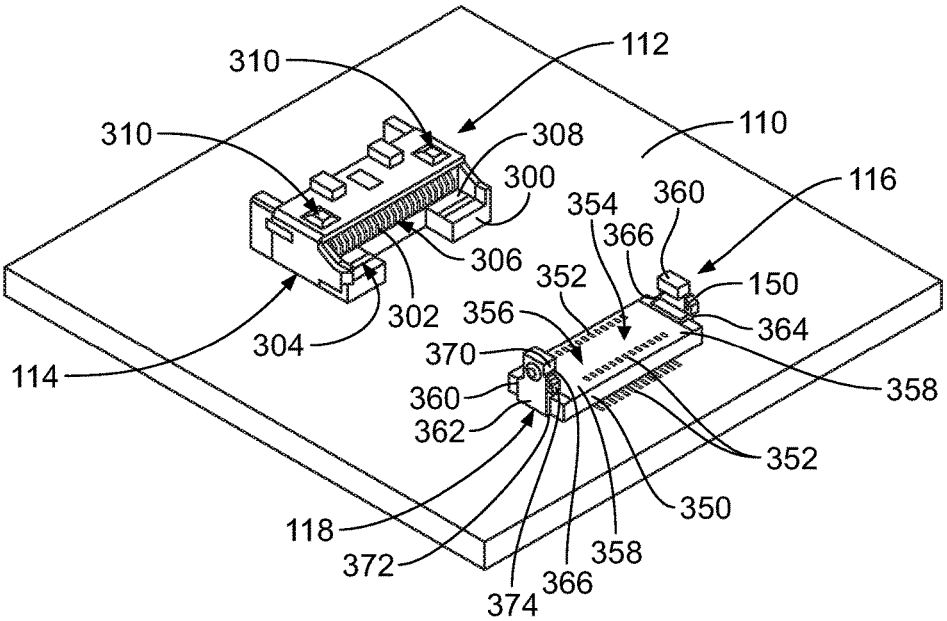
FIG. 4 is a top perspective view of the host circuit board in accordance with an exemplary embodiment.

FIG. 4 is a top perspective view of the host circuit board 110 in accordance with an exemplary embodiment. The host circuit board 110 includes mounting areas for mounting the dual connector module 102 (shown in FIG. 3) to the host circuit board 110. The mounting area is subdivided into the front mounting area 114 receiving the first electrical connector 112 and the rear mounting area 118 receiving the second electrical connector 116.

With additional reference to FIG. 3 for reference to components of the dual pluggable module 102, the first electrical connector 112 includes a housing 300 mounted to the host circuit board 110. The housing 300 holds a plurality of first contacts 302 configured to be terminated to the host circuit board 110. The housing 300 has a mating end 304 configured to be mated with the first connector interface 162 (FIG. 3) of the dual connector module 102. In an exemplary embodiment, the first electrical connector 112 includes a card slot 306 at the mating end 304. The first contacts 302 are arranged in the card slot 306 for mating with the first connector interface 162. For example, the first contacts 302 may be arranged in an upper row and a lower row for interfacing with the front contact pads 160 (FIG. 3) on the upper surface 132 and the lower surface 134 at the front edge 136 of the module circuit board 130.

The housing 300 includes locating surfaces 308 at the mating end 304 for locating the module circuit board 130 relative to the card slot 306 during mating. For example, the locating surfaces 308 may be upward facing surfaces configured to support the front edge 136 of the module circuit board 130 in the pre-staged position. The module circuit board 130 may slide along the locating surfaces 308 during mating as the front edge 136 of the module circuit board 130 is loaded into the card slot 306. The locating surfaces 308 may support the module circuit board 130 in the mated position to prevent damage to the first contacts 302 from the weight of the dual connector module 102.

The housing 300 includes one or more latching features 310. The latching features 310 interact with the latch 146 of the dual connector module 102 to secure the dual connector module 102 to the first electrical connector 112. For example, in the illustrated embodiment, the latching features 310 are openings in the top surface of the housing 300 that receive the hooks 194 of the corresponding latches 146. The latches 146 are releasable from the latching features 310. In a latched position, the latches 146 are received in the latching features 310 and retain the relative position of the dual connector module 102 with respect to the first electrical connector 112. For example, the latches 146 retain the front edge 136 of the module circuit board 130 in the card slot 306. When the latches 146 are released to an unlatched position, such as by pulling upward on the actuator 148, the dual connector module 102 may be unmated from the first electrical connector 112. For example, the dual connector module 102 may be moved rearward, such as by the releasing mechanisms 150.

Figure 5:
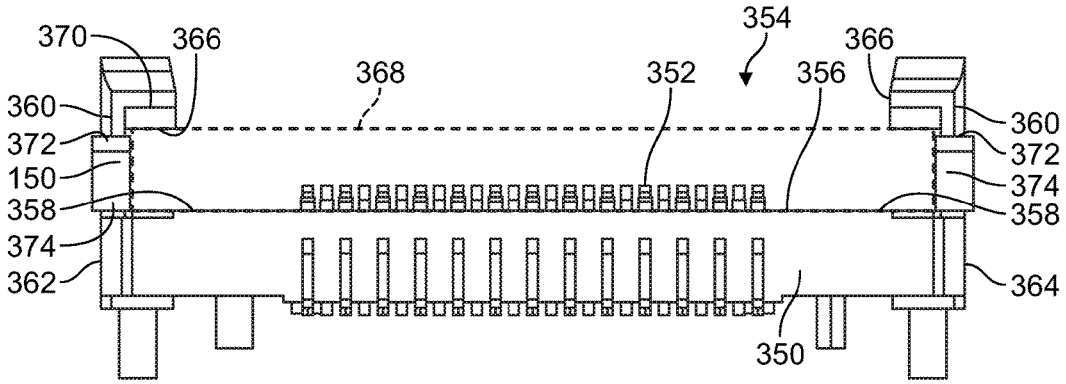
FIG. 5 is an end view of a second electrical connector of the host circuit board in accordance with an exemplary embodiment.

With additional reference to FIG. 5, which is an end view of the second electrical connector 116 in accordance with an exemplary embodiment, the second electrical connector 116 includes a housing 350 mounted to the host circuit board 110. The housing 350 holds a plurality of second contacts 352 configured to be terminated to the host circuit board 110. The housing 350 has a mating end 354 (for example, defining the top) configured to be mated with the second connector interface 166 (FIG. 3) of the dual connector module 102. In an exemplary embodiment, the second electrical connector 116 includes an upper mating surface 356 at the mating end 354. The second contacts 352 are arranged along the upper mating surface 356, such as in one or more rows, for mating with the second connector interface 166. The second contacts 352 may include deflectable spring beams configured to be resiliently biased against the second connector interface 166 when the dual connector module 102 is mated to the second electrical connector 116.

The housing 350 includes locating surfaces 358 at the mating end 354 for locating the module circuit board 130 during mating. For example, the locating surfaces 358 may be upward facing surfaces configured to support the intermediate portion 168 of the module circuit board 130. The housing 350 includes towers 360 extending above the locating surfaces 358, such as at opposite sides 362, 364 of the housing 350. The towers 360 may be integral with the base of the housing 350; however, the towers 360 may be separate components mounted to the base of the housing 350 in alternative embodiments. For example, the towers 360 may be die cast metal components attached to a molded plastic base of the housing 350 and/or the host circuit board 110 to provide additional rigidity for support and holding strength for the module circuit board 130 and/or to provide higher precision manufacturing and locating for the module circuit board 130.

The towers 360 include ledges 366, such as at distal or top ends of the towers 360, extending over the second electrical connector 116. The towers 360 and the ledges 366 form a gap 368 above the upper mating surface 356 that receives the module circuit board 130. The ledges 366 are configured to engage the upper surface 132 of the module circuit board 130, such as at the landing pads 176 (FIG. 3), to retain the module circuit board 130 in the gap 368 between the ledges 366 and the upper mating surface 356. The ledges 366 prevent lift-off of the module circuit board 130 when the dual connector module 102 is in the mated position. The module circuit board 130 is configured to bypass the towers 360 as the dual connector module 102 is loaded to the pre-staged position; however, when the dual connector module 102 is slid forward to the mated position, the module circuit board 130 is slid under the ledges 366 to the mated position.

The module circuit board 130 may slide along the locating surfaces 358 during mating as the front edge 136 of the module circuit board 130 is loaded into the card slot 306. The locating surfaces 358 may support the module circuit board 130, such as at the intermediate portion 168, in the mated position to prevent damage to the second contacts 352 from the weight of the dual connector module 102.

In an exemplary embodiment, the release mechanisms 150 are coupled to the second electrical connector 116. For example, the release mechanisms 150 are coupled to the towers 360 for interfacing with the dual connector module 102 when the dual connector module 102 is mated to the second electrical connector 116. In the illustrated embodiment, the release mechanisms 150 are coupled to rear ends 370 of the towers 360. The release mechanisms 150 may be stamped and formed from sheet metal into a spring shape, such as a leaf spring shape. Each release mechanism 150 includes a base 372 mounted to the tower 360 and a spring beam 374 extending from the base 372. The spring beam 374 is deflectable and is configured to be compressed against the dual connector module 102. When the spring beams 382 are compressed, the spring beams 382 are resiliently deformed and are thus spring biased outward against the dual connector module 102. For example, when compressed, the spring beam 374 develops an internal spring biasing force. The spring beam 374 presses against the dual connector module 102 and forces the dual connector module 102 rearward.

Figure 6:
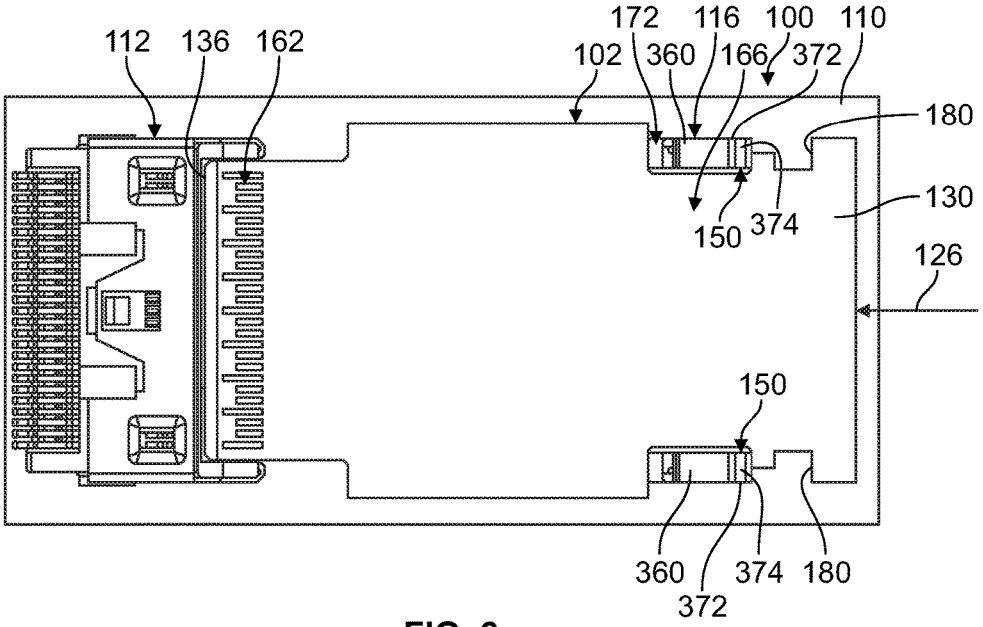
FIG. 6 is a top view of a portion of the dual connector system showing a module circuit board partially mated to the host circuit board.
Figure 7:
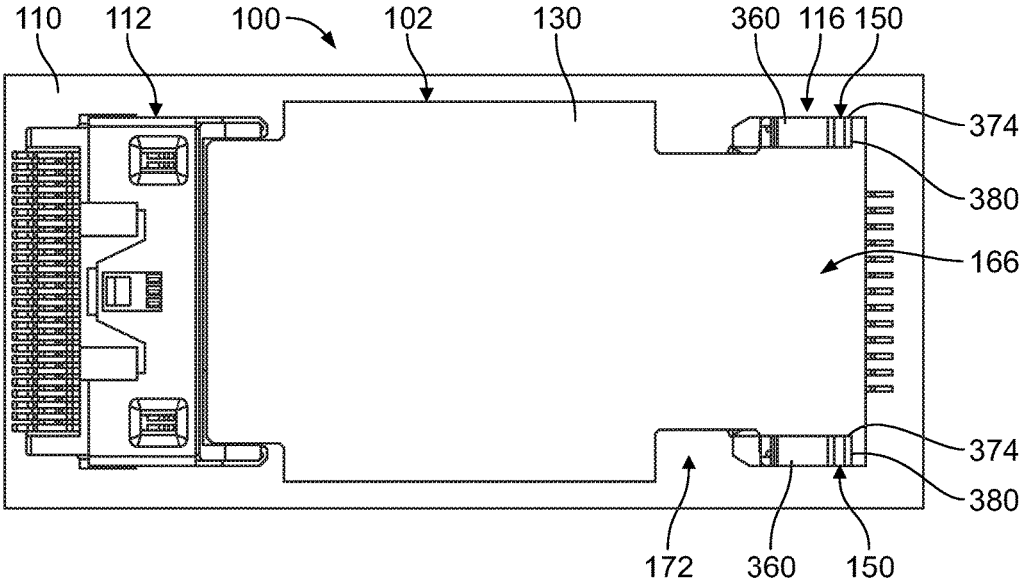
FIG. 7 is a top view of a portion of the dual connector system showing the module circuit board fully mated to the host circuit board.

FIG. 6 is a top view of a portion of the dual connector system 100 showing the module circuit board 130 partially mated to the host circuit board 110. FIG. 7 is a top view of a portion of the dual connector system 100 showing the module circuit board 130 fully mated to the host circuit board 110. The release mechanisms 150 extend from the towers 360 to engage the module circuit board 130; however the release mechanisms 150 may extend from the dual connector module 102 to engage the second electrical connector 116 or the first electrical connector 112 in alternative embodiments.

In an exemplary embodiment, mating of the dual connector module 102 to the host circuit board 110 (and the electrical connectors 112, 116) occurs by loading the dual connector module 102 in the loading direction 124 (shown in FIG. 2) to the pre-staged, unmated position (FIG. 6), such as by loading the dual connector module 102 downward onto the first and second electrical connectors 112, 116. Once positioned, the dual connector module 102 is mated to the first and second electrical connectors 112, 116 by moving the dual connector module 102 in the mating direction 126 to the mated position (FIG. 7).

During mating, the first connector interface 162 is generally aligned above the first electrical connector 112 and the second connector interface 166 is generally aligned above the second electrical connector 116 and the module circuit board 130 is lowered into position on the first and second electrical connectors 112, 116 to the pre-staged, unmated position. The front edge 136 of the module circuit board 130 rests on, and is supported by, the first electrical connector 112 in the pre-staged, unmated position (FIG. 6). As the module circuit board 130 is lowered, the towers 360 of the second electrical connector 116 extend into the cutouts 172 in the module circuit board 130. The release mechanisms 150 are received in the cutouts 172 at opposite sides of the module circuit board 130.

As the dual connector module 102 is moved from the pre-staged, unmated position (FIG. 6) to the mated position (FIG. 7), the release mechanisms 150 are compressed. The bases 372 of the release mechanisms 150 are mounted to the towers 360. The spring beams 374 of the release mechanisms 150 extend from the bases 372. The portion of the module circuit board 130 rearward of the cutouts 172 is moved forward to a position between the towers 360. The release mechanisms 150 engage the pressing surfaces 180 (and/or the pressing surfaces 182 of the shell 142, both shown in FIG. 3). The spring beams 374 are deflected and compressed by the pressing surfaces 180 (and/or the pressing surfaces 182). The spring beams 374 press against the pressing surfaces 180 (and/or the pressing surfaces 182). The dual connector module 102 is latchably secured to the first electrical connector 112, as described above. However, when the latches 146 (shown in FIG. 3) are released, the release mechanisms 150 cause the dual connector module 102 to shift rearward to the unmated position.

Figure 8:
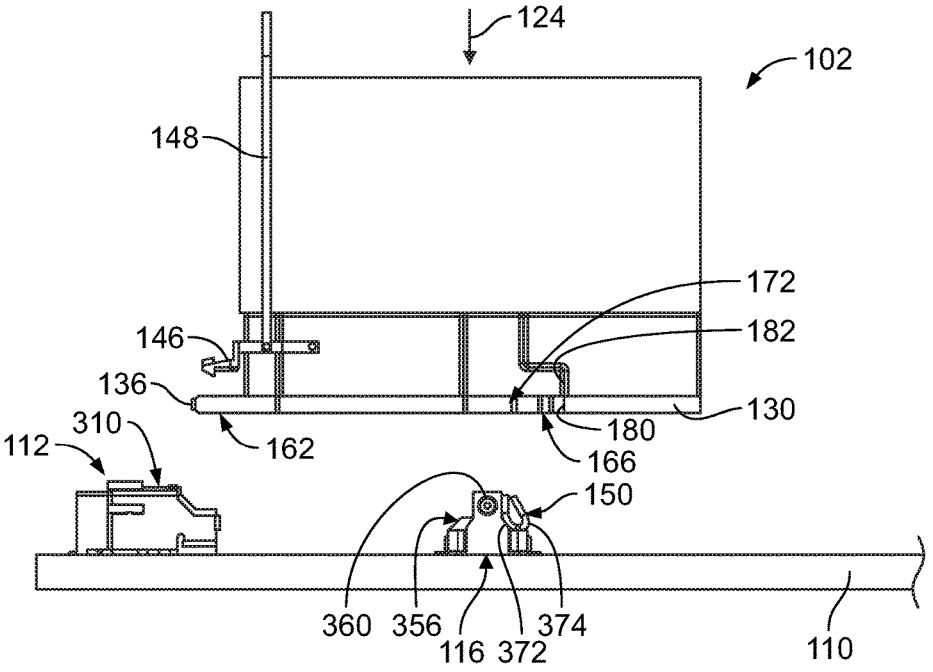
FIG. 8 shows the dual connector module 102 poised for coupling to the host circuit board at an elevated positioned above the host circuit board.
Figure 9:
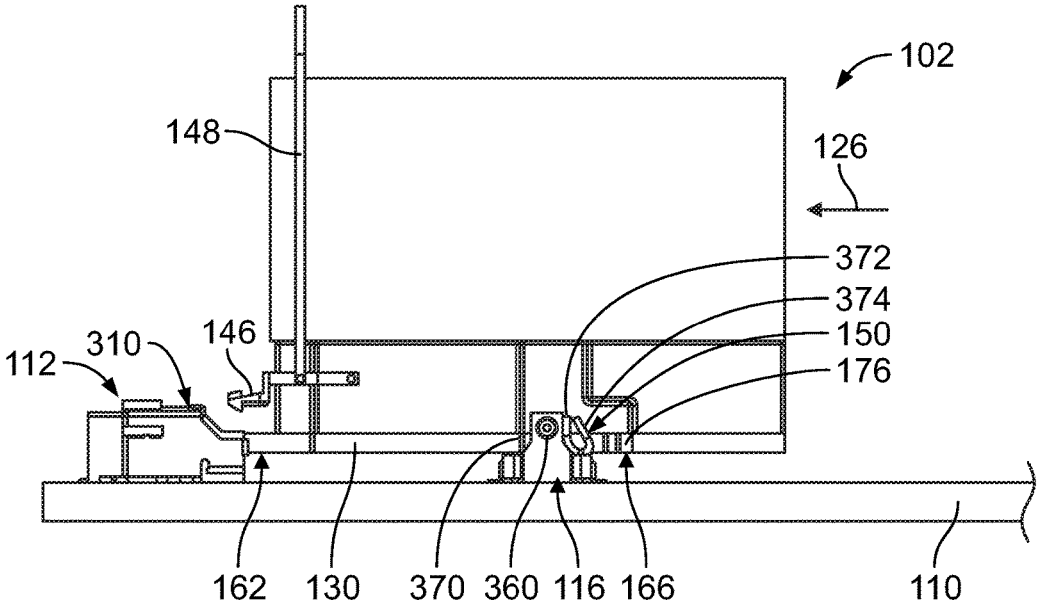
FIG. 9 shows the dual connector module in a pre-staged position on the host circuit board.
Figure 10:
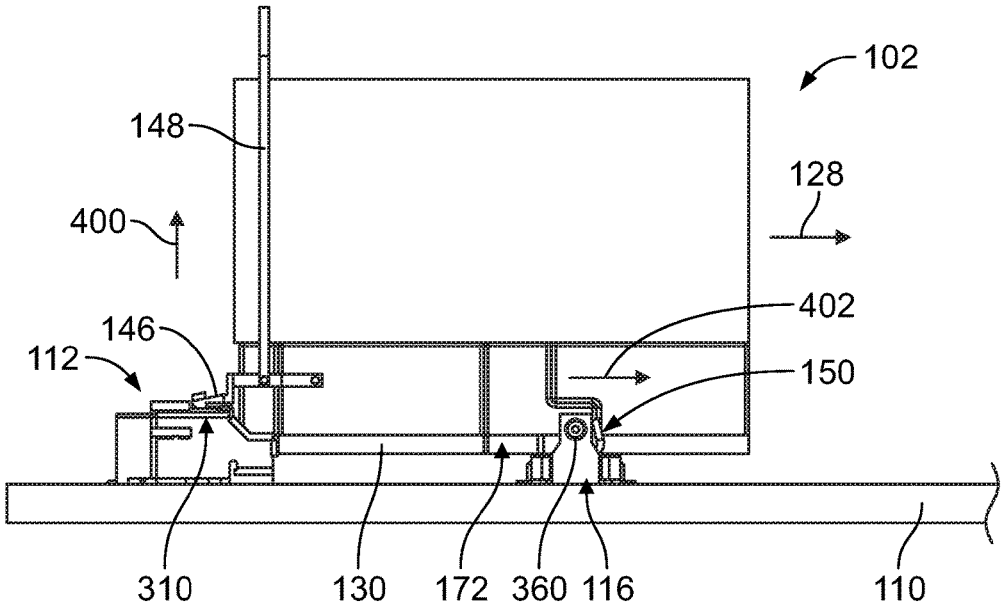
FIG. 10 shows the dual connector module in a mated position on the host circuit board.

FIGS. 8 through 10 show a mating sequence of the dual connector module 102 to the host circuit board 110. FIG. 8 shows the dual connector module 102 poised for coupling to the host circuit board 110 at an elevated positioned above the host circuit board 110. FIG. 9 shows the dual connector module 102 in a pre-staged, unmated position. FIG. 10 shows the dual connector module 102 in a mated position.

In an exemplary embodiment, mating of the dual connector module 102 to the host circuit board 110 occurs by loading the dual connector module 102 in the loading direction 124 to the pre-staged, unmated position (FIG. 9), such as by loading the dual connector module 102 downward onto the first and second electrical connectors 112, 116. Once positioned, the dual connector module 102 is mated to the first and second electrical connectors 112, 116 by moving the dual connector module 102 in the mating direction 126 to the mated position (FIG. 10).

During assembly, the first connector interface 162 is generally aligned above the first electrical connector 112 and the second connector interface 166 is generally aligned above the second electrical connector 116 (FIG. 8) and the module circuit board 130 is lowered into position on the first and second electrical connectors 112, 116 to the pre-staged position (FIG. 9). The front edge 136 of the module circuit board 130 rests on, and is supported by, the first electrical connector 112 in the pre-staged, unmated position. As the module circuit board 130 is lowered, the tower 360 of the second electrical connector 116 extends into the cutout 172 in the module circuit board 130. The release mechanism 150 is received in the cutout 172. The release mechanism 150 includes the base 372 mounted to the tower 360 and the spring beam 374 extending from the base 372; however, the base 372 may be mounted to the dual connector module 102 in alternative embodiments such that the spring beam 374 engages the second electrical connector 116.

As the dual connector module 102 is moved from the pre-staged, unmated position (FIG. 9) to the mated position (FIG. 10), the release mechanism 150 is compressed between the dual connector module 102 and the second electrical connector 116. The module circuit board 130 rearward of the cutout 172 is moved forward in line with the tower 360. For example, the module circuit board 130 is slid forward relative to the second electrical connector 116. In the mated position, the ledge 366 of the tower 360 is positioned above the landing pad 176 of the module circuit board 130 to hold the vertical position of the module circuit board 130 within the second electrical connector 116. For example, the module circuit board 130 is captured between the ledge 366 and the upper mating surface 356. The ledge 366 prevents lift-off of the module circuit board 130 from the upper mating surface 356.

When the dual connector module 102 is slid forward to the mated position, the latch 146 engages the latching feature 310 to latchably secure the dual connector module 102 in the mated position. When the actuator 148 is operated (for example, pulled upward), the latch 146 is released in a releasing direction 400 perpendicular to an acting direction 402 of the release mechanism 150. For example, the releasing direction 400 is vertically upward and the spring force acting direction 402 is horizontally rearward in the illustrated embodiment. The release mechanism 150 forces the dual connector module 102 in the rearward unmating direction 128. The release mechanism 150 is extended as the dual connector module 102 is moved from the mated position to the unmated position.

Figure 11:
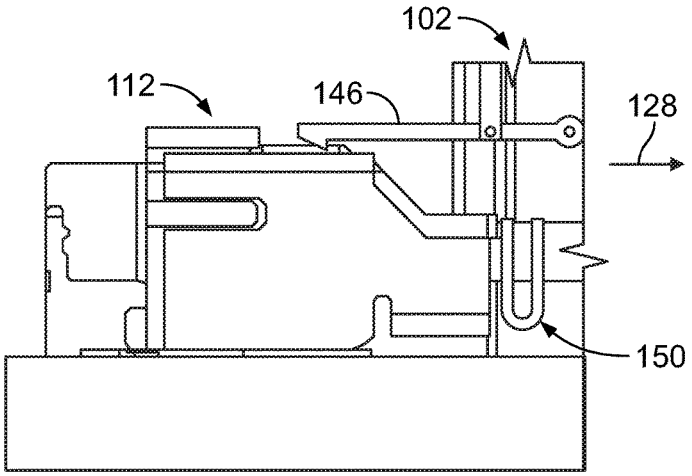
FIG. 11 is a side view of a portion of the dual connector system 100 in accordance with an exemplary embodiment.

FIG. 11 is a side view of a portion of the dual connector system 100 in accordance with an exemplary embodiment. FIG. 11 illustrates the first electrical connector 112 and the release mechanism 150 between the first electrical connector 112 and the dual connector module 102. Optionally, the release mechanism 150 may be coupled to the first electrical connector 112 and presses against the dual connector module 102 to force the dual connector module 102 in the rearward unmating direction 128 when the latch 146 is released. Alternatively, the release mechanism 150 may be coupled to the dual connector module 102 and presses against the first electrical connector 112 to force the dual connector module 102 in the rearward unmating direction 128 when the latch 146 is released.

Figure 12:
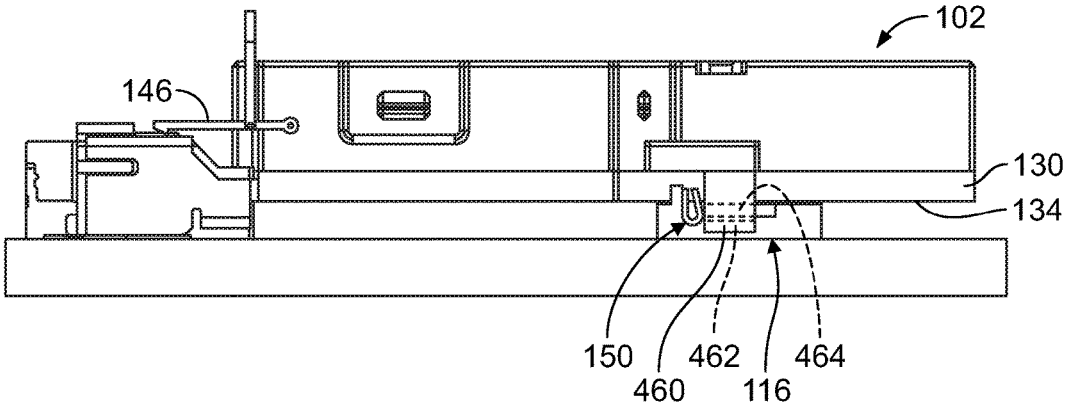
FIG. 12 is a side view of a portion of the dual connector system 100 in accordance with an exemplary embodiment.

FIG. 12 is a side view of a portion of the dual connector system 100 in accordance with an exemplary embodiment. FIG. 12 illustrates a different connection arrangement between the second electrical connector 116 and the dual connector module 102. Rather than using the towers 360 (shown in FIG. 5), the dual connector module 102 includes a tab 460 extending downward below the lower surface 134 of the module circuit board 130 to engage the second electrical connector 116. For example, the tab 460 includes a ledge 462 (shown in phantom) and the second electrical connector 116 includes a ledge 464 (shown in phantom). As the dual connector module 102 is moved forward from the unmated position to the mated position, the ledge 462 is captured below the ledge 464 to hold the dual connector module 102 downward against the mating surface of the second electrical connector 116 and prevent lift-off of the dual connector module 102.

In an exemplary embodiment, the release mechanism 150 is positioned between the second electrical connector 112 and the dual connector module 102. For example, the release mechanism 150 is positioned between the second electrical connector 116 and the tab 460. Optionally, the release mechanism 150 may be coupled to the second electrical connector 112 and presses against the tab 460 to force the dual connector module 102 in the rearward unmating direction 128 when the latch 146 is released. Alternatively, the release mechanism 150 may be coupled to the tab 460 and presses against the second electrical connector 112 to force the dual connector module 102 in the rearward unmating direction 128 when the latch 146 is released.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board, the first electrical connector having a latching feature;

a second electrical connector at the rear mounting area of the host circuit board, the second electrical connector having a housing having an upper mating surface, the housing holding second contacts at the upper mating surface, the second contacts being terminated to the host circuit board;

a dual connector module movable between a mated position and an unmated position with the first and second electrical connectors, the dual connector module having a module circuit board including an upper surface and a lower surface facing the host circuit board, the module circuit board having at least one communication component on the upper surface, the module circuit board having first and second side edges extending between a front edge and a rear edge, the module circuit board having front contact pads proximate to the front edge for electrically connecting to the first electrical connector, the module circuit board having rear contact pads remote from the front edge for electrically connecting to the second electrical connector, the dual connector module having a latch movable between a latched position and an unlatched position, the latch engaging the latching feature of the first electrical connector in the latched position to hold the dual connector module in the mated position with the first electrical connector; and a release mechanism operably coupled between the dual connector module and at least one of the first electrical connector and the second electrical connector, the release mechanism forcing the dual connector module to the unmated position after the latch is moved from the latched position to the unlatched position.

2. The dual connector system of claim 1, wherein the release mechanism ejects the dual connector module from the first electrical connector.

3. The dual connector system of claim 1, wherein the release mechanism includes a spring imparting a spring force on the dual connector module in an un-mating direction parallel to the host circuit board.

4. The dual connector system of claim 1, wherein the release mechanism is compressed as the dual connector module is moved from the unmated position to the mated position and the release mechanism is extended as the dual connector module is moved from the mated position to the unmated position.

5. The dual connector system of claim 1, wherein the dual connector module includes a tab extending below the lower surface of the module circuit board, the tab engaging the second electrical connector, the release mechanism being positioned between the tab and the second electrical connector.

6. The dual connector system of claim 5, wherein the tab engages a ledge of the second electrical connector to prevent lift off of the module circuit board from the upper mounting surface of the second electrical connector.

7. The dual connector system of claim 1, wherein the release mechanism is coupled to the second electrical connector remote from the latch and is compressed by the dual connector module when the dual connector module is moved from the unmated position to the mated position.

8. The dual connector system of claim 1, wherein the release mechanism is coupled to the first electrical connector and is compressed by the dual connector module when the dual connector module is moved from the unmated position to the mated position.

9. The dual connector system of claim 1, wherein the release mechanism is coupled to the dual connector module and is compressed by the dual connector module against at least one of the first electrical connector and the second electrical connector when the dual connector module is moved from the unmated position to the mated position.

10. The dual connector system of claim 1, wherein the latch is released in a releasing direction perpendicular to the acting direction of the release mechanism.

11. The dual connector system of claim 1, wherein the latch includes a latching beam engaging the latching feature and an actuator coupled to the latching beam and operated to actuate the latching beam from the latched position to the unlatched position.

12. The dual connector system of claim 11, wherein the latching beam and the actuator are contained forward of the second electrical connector.

13. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board, the first electrical connector having a latching feature;

a second electrical connector at the rear mounting area of the host circuit board, the second electrical connector having a housing having an upper mating surface, the housing holding second contacts at the upper mating surface, the second contacts being terminated to the host circuit board;

a dual connector module matable with the first and second electrical connectors, the dual connector module having a module circuit board including an upper surface and a lower surface facing the host circuit board, the module circuit board having at least one communication component on the upper surface, the module circuit board having first and second side edges extending between a front edge and a rear edge, the module circuit board having front contact pads proximate to the front edge for electrically connecting to the first electrical connector, the module circuit board having rear contact pads remote from the front edge for electrically connecting to the second electrical connector, the dual connector module having a latch movable between a latched position and an unlatched position, the latch engaging the latching feature of the first electrical connector in the latched position, wherein the dual connector module is coupled to the host circuit board by lowering the dual connector module in a loading direction generally perpendicular to the host circuit board to a pre-staged, unmated position where the first connector interface is adjacent to the first electrical connector and the second connector interface is adjacent to the second electrical connector, and wherein the dual connector module is slid forward from the pre-staged, unmated position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads; and a release mechanism operably coupled between the dual connector module and at least one of the first electrical connector and the second electrical connector, the release mechanism forcing the dual connector module to the pre-staged unmated position after the latch is moved from the latched position to the unlatched position.

14. The dual connector system of claim 13, wherein the release mechanism ejects the dual connector module from the first electrical connector.

15. The dual connector system of claim 13, wherein the release mechanism includes a spring imparting a spring force on the dual connector module in an un-mating direction parallel to the host circuit board.

16. The dual connector system of claim 13, wherein the release mechanism is compressed as the dual connector module is moved from the unmated position to the mated position and the release mechanism is extended as the dual connector module is moved from the mated position to the unmated position.

17. The dual connector system of claim 13, wherein the dual connector module includes a tab extending below the lower surface of the module circuit board, the tab engaging the second electrical connector, the release mechanism being positioned between the tab and the second electrical connector.

18. The dual connector system of claim 13, wherein the release mechanism is coupled to the second electrical connector remote from the latch and is compressed by the dual connector module when the dual connector module is moved from the unmated position to the mated position.

19. The dual connector system of claim 13, wherein the latch is released in a releasing direction perpendicular to the acting direction of the release mechanism.

20. A dual connector system comprising:

a host circuit board having a front mounting area and a rear mounting area;

a first electrical connector at the front mounting area of the host circuit board, the first electrical connector having a first connector housing having a card slot configured to receive a front edge of a module circuit board of a dual connector module in a mating direction parallel to the host circuit board, the first connector housing holding first contacts at the card slot configured to be electrically connected to contact pads at the front edge of the module circuit board, the first contacts being terminated to the host circuit board, the first electrical connector having a latching feature configured to engage a latch of the dual connector module to secure the dual connector module in a mated position when the latch engages the latching feature; and a second electrical connector at the rear mounting area of the host circuit board, the second electrical connector having a second connector housing having an upper mating surface configured to receive the module circuit board when mounted thereto, the second connector housing having a release mechanism coupled thereto configured to engage the dual connector module, the release mechanism configured to impart a releasing force on the dual connector module in an unmating direction opposite the mating direction parallel to the host circuit board to cause the dual connector module to move to an unmated position in the unmating direction after the latch is unlatched from the latching feature of the first electrical connector.

* * * * *